US011011081B1

(12) United States Patent
Boampong

(10) Patent No.: US 11,011,081 B1
(45) Date of Patent: May 18, 2021

(54) TRANSPARENT DISPLAY CASE ASSEMBLY

(71) Applicant: Joseph Boampong, Minneapolis, MN (US)

(72) Inventor: Joseph Boampong, Minneapolis, MN (US)

( * ) Notice: Subject to any disclaimer, the term of this patent is extended or adjusted under 35 U.S.C. 154(b) by 0 days.

(21) Appl. No.: 16/834,859

(22) Filed: Mar. 30, 2020

(51) Int. Cl.
*G09F 7/10* (2006.01)
*G09F 15/00* (2006.01)

(52) U.S. Cl.
CPC ..... *G09F 7/10* (2013.01); *G09F 15/005* (2013.01); *G09F 15/0018* (2013.01)

(58) Field of Classification Search
CPC ..... A47F 5/0807; A47F 5/0823; G09F 1/10; G09F 3/16; G09F 3/20; G09F 7/02; G09F 7/08; G09F 7/10; G09F 7/18; G09F 15/0006; G09F 15/0012; G09F 15/005
See application file for complete search history.

(56) References Cited

U.S. PATENT DOCUMENTS 224,684 A * 2/1880 Harris ..... G09F 7/00 40/585
1,038,844 A * 9/1912 Burger ..... G09F 7/00 40/611.07
1,532,896 A 4/1925 Hall
1,830,508 A 11/1931 Cowing
3,883,967 A * 5/1975 Barnes ..... G09F 7/08 40/611.05
4,138,787 A * 2/1979 Sarkisian ..... G09F 1/12 40/618
4,357,773 A * 11/1982 Dennis ..... G09F 7/02 40/606.18
4,679,341 A 7/1987 Goldman
5,651,202 A 7/1997 Hewitt
D398,653 S 9/1998 Hiraguchi
6,108,955 A * 8/2000 Folsom ..... G09F 7/10 40/618
6,438,880 B2 * 8/2002 Dundorf ..... G09F 7/10 40/5
9,486,094 B2 11/2016 Killian
2003/0070337 A1 * 4/2003 Music ..... G09F 7/10 40/618
2005/0127013 A1 * 6/2005 Krapf ..... G09F 15/00 211/45
2010/0251585 A1 10/2010 Schaefer

* cited by examiner

*Primary Examiner* — Cassandra Davis

(57) ABSTRACT

A transparent display case assembly for displaying planar cards includes a panel that has a plurality of planar cards that are positionable thereon. A plurality of clips is provided and each of the clips is coupled to the panel. Each of the clips is biased to abut the panel to grip a respective one of the planar card. Each of the clips is urgeable away from the panel to facilitate the document to be put into or taken out of the clips. A frame is provided that has a pair of grooves therein for slidably engaging the panel. The frame has a viewing opening and a back wall, and the viewing opening is open into an interior of the frame such that the panel is visible through the viewing opening.

10 Claims, 8 Drawing Sheets

TRANSPARENT DISPLAY CASE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to display devices and more particularly pertains to a new display device for displaying planar cards.

(2) Description of Related Art Including Information Disclosed Under 37 CFR 1.97 and 1.98

The prior art relates to display devices including a bulletin board that has a window for displaying a planar card. Additionally, the prior art discloses a document panel that includes a plurality of pockets each being capable of storing a planar card. The prior art discloses a display device that has a plurality of viewing openings for displaying a plurality of signs being positioned in the display device. The prior art discloses a card display device that includes a plurality of sheaths, being arranged into a plurality of columns and rows, for storing and displaying a plurality of cards. The prior art discloses a display device that includes a back panel and a front frame that is attachable to the back panel for displaying a plurality of planar cards.

BRIEF SUMMARY OF THE INVENTION

An embodiment of the disclosure meets the needs presented above by generally comprising a panel that has a plurality of planar cards that are positionable thereon. A plurality of clips is provided and each of the clips is coupled to the panel. Each of the clips is biased to abut the panel to grip a respective one of the planar card. Each of the clips is urgeable away from the panel to facilitate the document to be put into or taken out of the clips. A frame is provided that has a pair of grooves therein for slidably engaging the panel.

The frame has a viewing opening and a back wall, and the viewing opening is open into an interior of the frame such that the panel is visible through the viewing opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
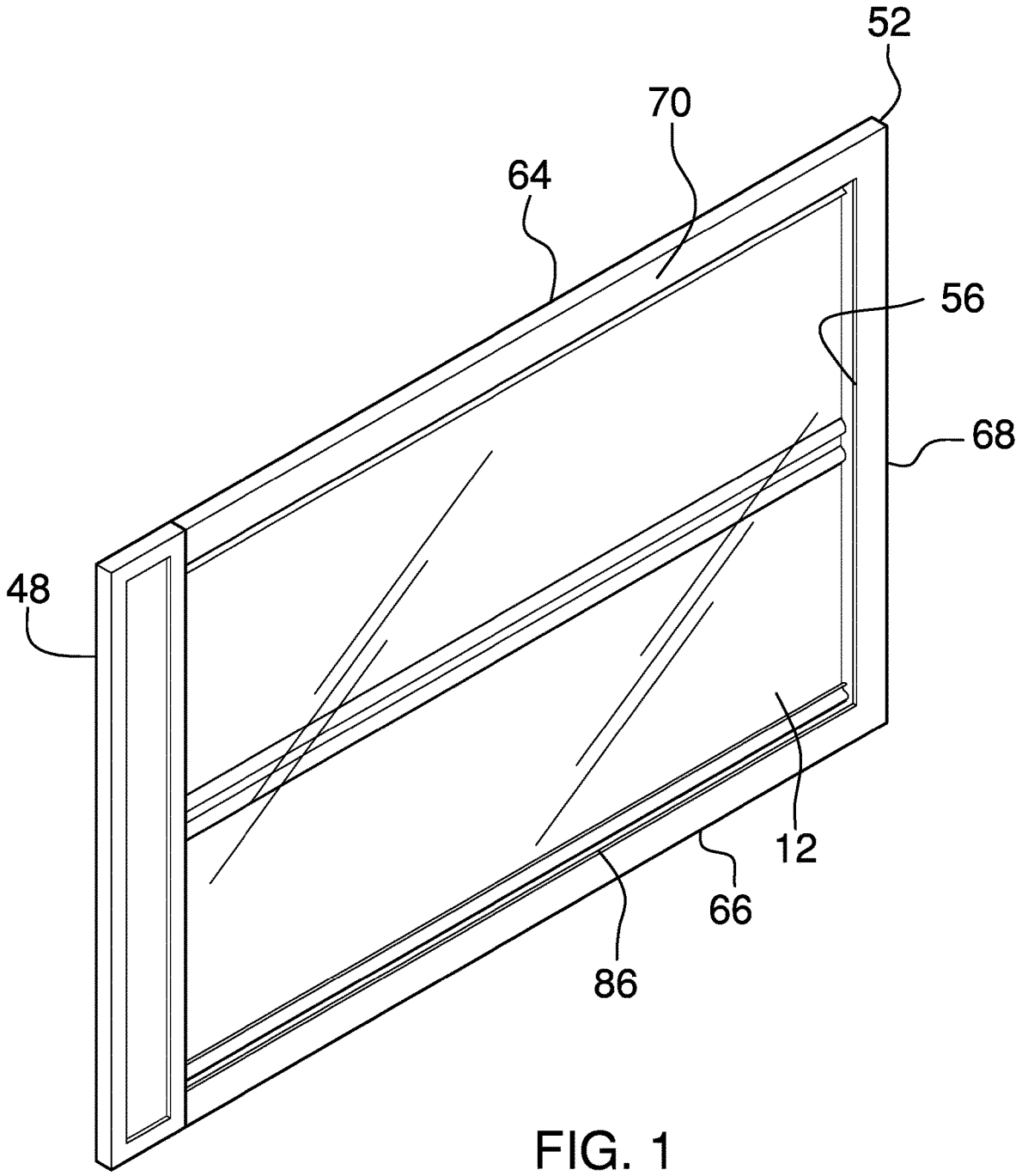
FIG. 1 is a front perspective view of a transparent display case assembly according to an embodiment of the disclosure.
Figure 2:
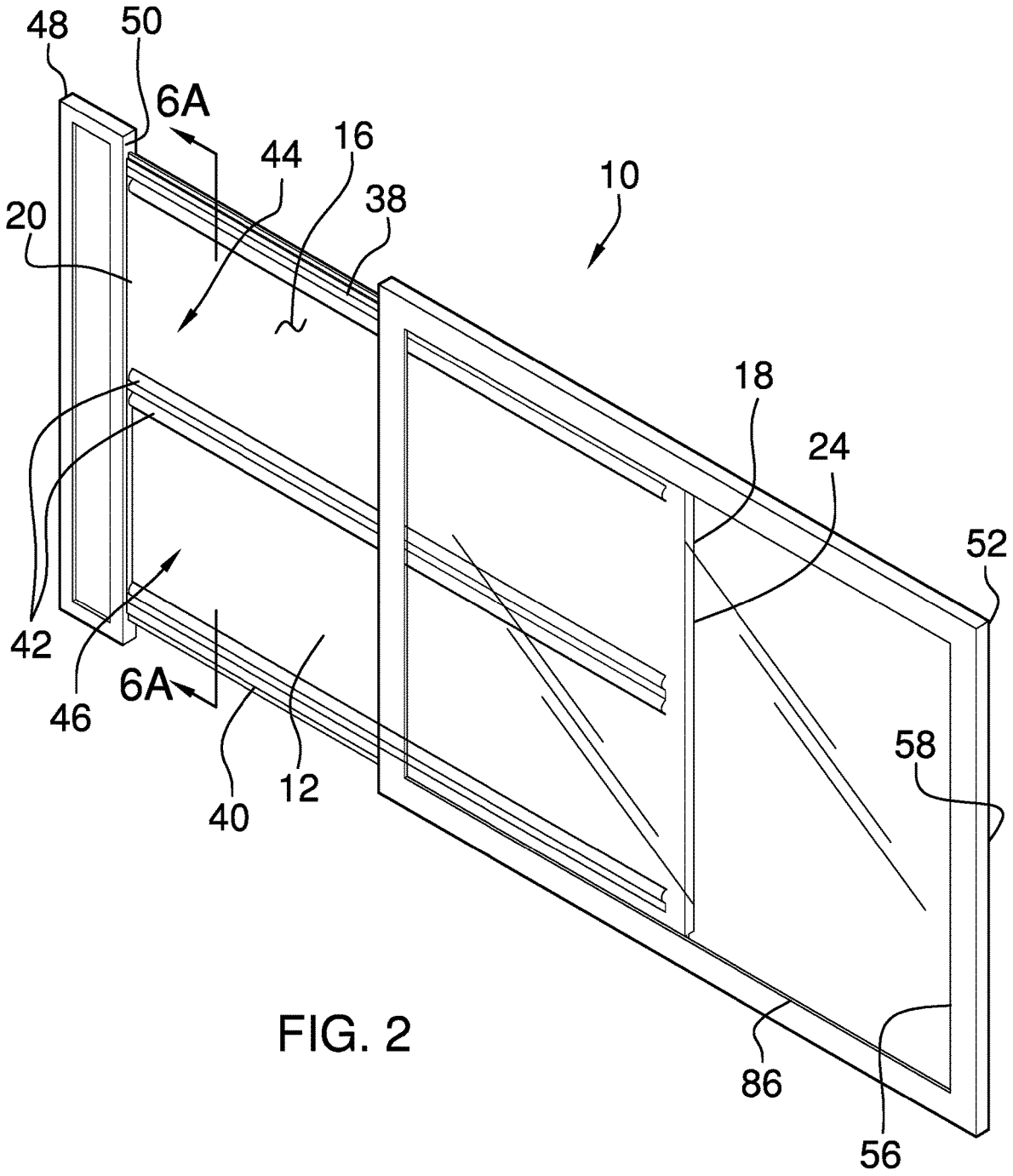
FIG. 2 is a front perspective view of an embodiment of the disclosure showing a panel being removed from a frame.
Figure 3:
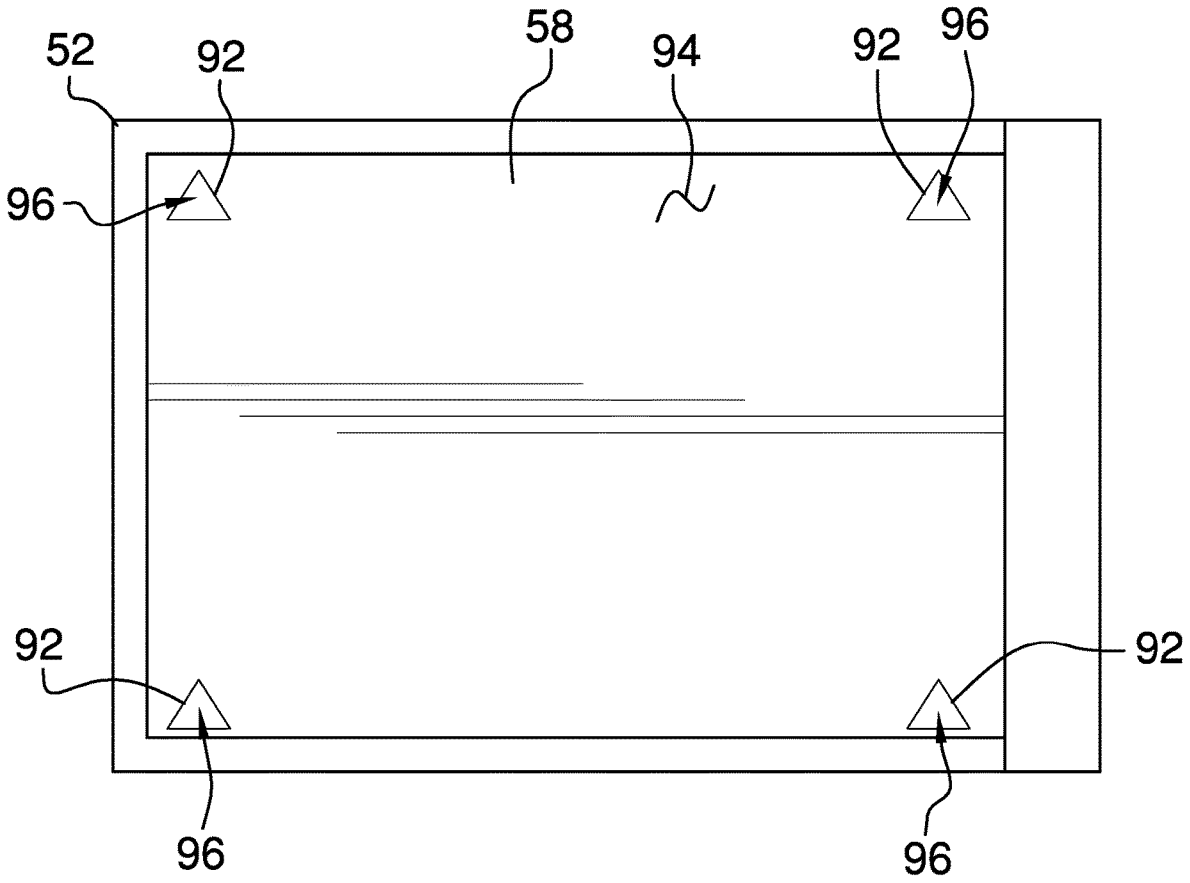
FIG. 3 is a back view of an embodiment of the disclosure.
Figure 4:
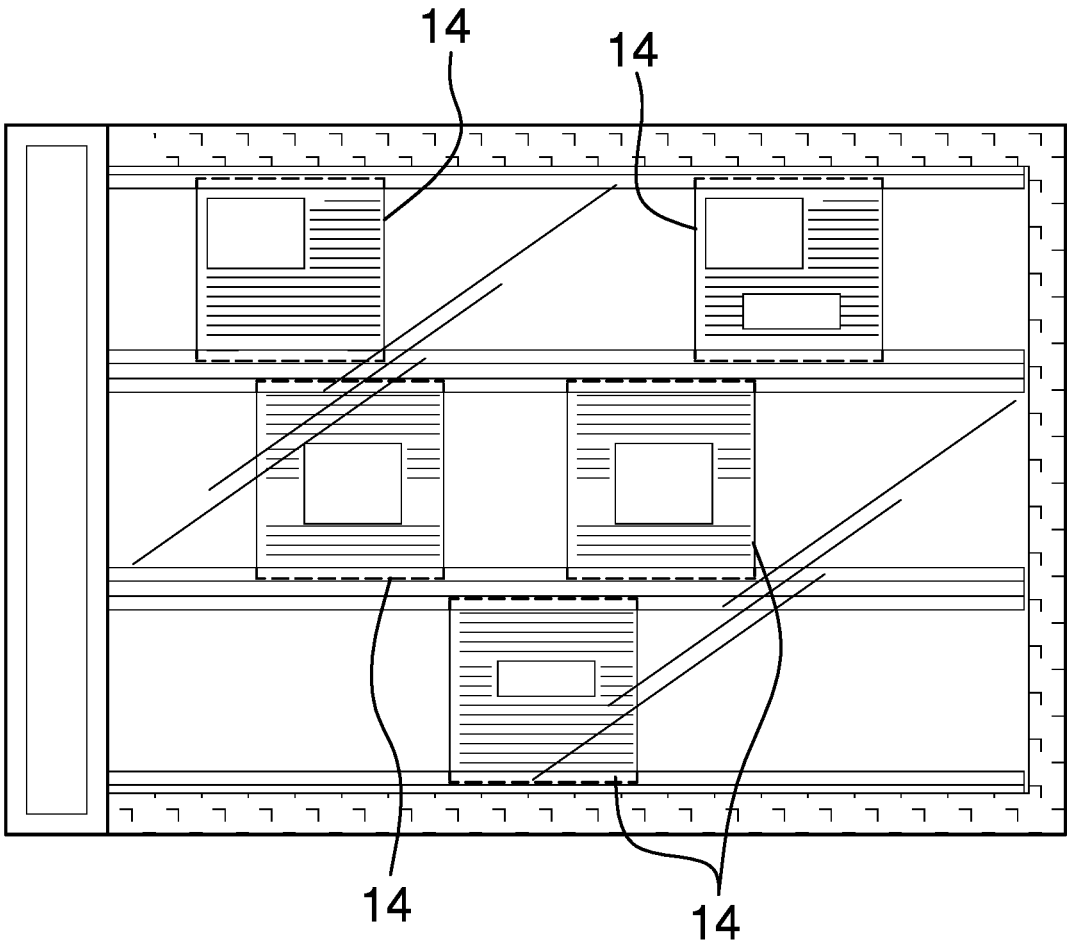
FIG. 4 is a front in-use view of an embodiment of the disclosure.

With reference now to the drawings, and in particular to FIGS. 1 through 7 thereof, a new display device embodying the principles and concepts of an embodiment of the disclosure and generally designated by the reference numeral 10 will be described.

As best illustrated in FIGS. 1 through 7, the transparent display case assembly 10 generally comprises a panel 12 for displaying a plurality of planar card 14, or any other planar object, thereon. The planar card 14 may comprise pictures, paintings, printed planar card, trading cards or any other planar object that a user may wish to display. The panel 12 has a front surface 16 and a perimeter edge 18, and the perimeter edge 18 has a first lateral side 20, a second lateral side 22, a top side 24 and a bottom side 26. The top side 24 has a top rail 28 extending upwardly therefrom and the top rail 28 extends between the first lateral side 20 and the second lateral side 22. The bottom side 26 has a bottom rail 30 and the bottom rail 30 extends between the first lateral side 20 and the second lateral side 22.

A plurality of clips 32 is provided and each of the clips 32 is coupled to the panel 12. Each of the clips 32 is biased to abut the panel 12 to grip a respective one of the planar card 14. Each of the clips 32 is urgeable away from the panel 12 to facilitate the document to be put into or taken out of the clips 32. Each of the clips 32 has a first edge 34 and a second edge 36, and each of the clips 32 is curved between the first edge 34 and the second edge 36. The first edge 34 of each of the clips 32 is coupled to the front surface 16 of the panel 12 has each of the clips 32 curves outwardly from the front surface 16. The second edge 36 of each of the clips 32 is biased to abut the front surface 16.

Each of the clips 32 is oriented to extend between the first lateral side 20 and the second lateral side 22 of the perimeter edge 18 of the panel 12. The clips 32 are spaced apart from each other and are distributed between the top side 24 and the bottom side 26 of the perimeter edge 18 of the panel 12. The plurality of clips 32 includes a top clip 38, a bottom clip 40 and a pair of middle clips 42. The top clip 38 is aligned with the top side 24 and the bottom clip 40 is aligned with the bottom side 26. Additionally, each of the middle clips 42 each is centrally positioned between the top side 24 and the bottom side 26. The top clips 38 and the middle clips 42 defining a first portion 44 of the panel 12 extending between middle clips 42 and the top clip 38. The bottom clip 40 and the middle clips 42 defining a second portion 46 of the panel 12 extending between the middle clips 42 and the bottom clip 40. Each of the middle clips 42 may be removably attached to the panel 12 thereby facilitating the middle clips 42 to be rearranged as is most clearly shown in FIG. 4. A member 48 is provided that has a sidelong edge 50 and the sidelong edge 50 is coupled to the first lateral side 20 of the perimeter edge 18 of the panel 12. Moreover, the member 48 can be gripped by a user.

A frame 52 is included that has a pair of grooves 54 therein for slidably engaging the panel 12. The frame 52 has a viewing opening 56 and a back wall 58, and the viewing opening 56 is open into an interior of the frame 52 such that the panel 12 is visible through the viewing opening 56. In this way the frame 52 can display the planar card 14 on the panel 12.

The back wall 58 has a front surface 60 and a peripheral edge 62, and the peripheral edge 62 has an upper side 64, a lower side 66 and a first lateral side 68. The frame 52 has a prominence 70 extending forwardly from the front surface 16 of the back wall 58. The prominence 70 includes an upper portion 72 extending along the upper side 64 of the peripheral edge 62 and the prominence 70 includes a lower portion 74 extending along the lower side 66 of the peripheral edge 62. The prominence 70 has a first lateral portion 76 extending along the first lateral side 20 of the peripheral edge 62.

Each of the upper portion 72 and the lower portion 74 the prominence 70 has a first surface 78 that is directed toward a center of the front surface 16 of the back wall 58. The first surface 78 of the upper portion 72 and the first surface 78 of the lower portion 74 define the viewing opening 56 in the frame 52. Each of the grooves 54 extends into the first surface 78 of a respective one of the upper portion 72 and the lower portion 74. Additionally, each of the grooves 54 extends along a full length of the respective upper portion 72 and lower portion 74. Each of the grooves 54 slidably receives a respective one of the top rail 28 and the bottom rail 30 on the panel 12. Additionally, the member 48 on the panel 12 abuts the frame 52 when the panel 12 is fully inserted into the frame 52.

A window 86 is provided and the window 86 is coupled to the frame 52. The window 86 covers the viewing opening 56 to protect the planar card 14 displayed in the case. The window 86 is comprised of a translucent material to facilitate the planar card 14 to be visible through the window 86. Additionally, the window 86 may be comprised of a shatter resistant material to reduce the likely hood of injury due to impact with the window 86. As is most clearly shown in FIG. 3, a plurality of engagements 92 may be integrated into a back surface 94 of the back wall 58 of the frame 52. Each of the engagements 92 may engage a nail or hook on a wall for suspending the frame 52 on the wall. Additionally, each of the engagements 92 may comprise a triangular well 96 that extends into the back surface 94 of the back wall 58 of the frame 52.

Figure 5:
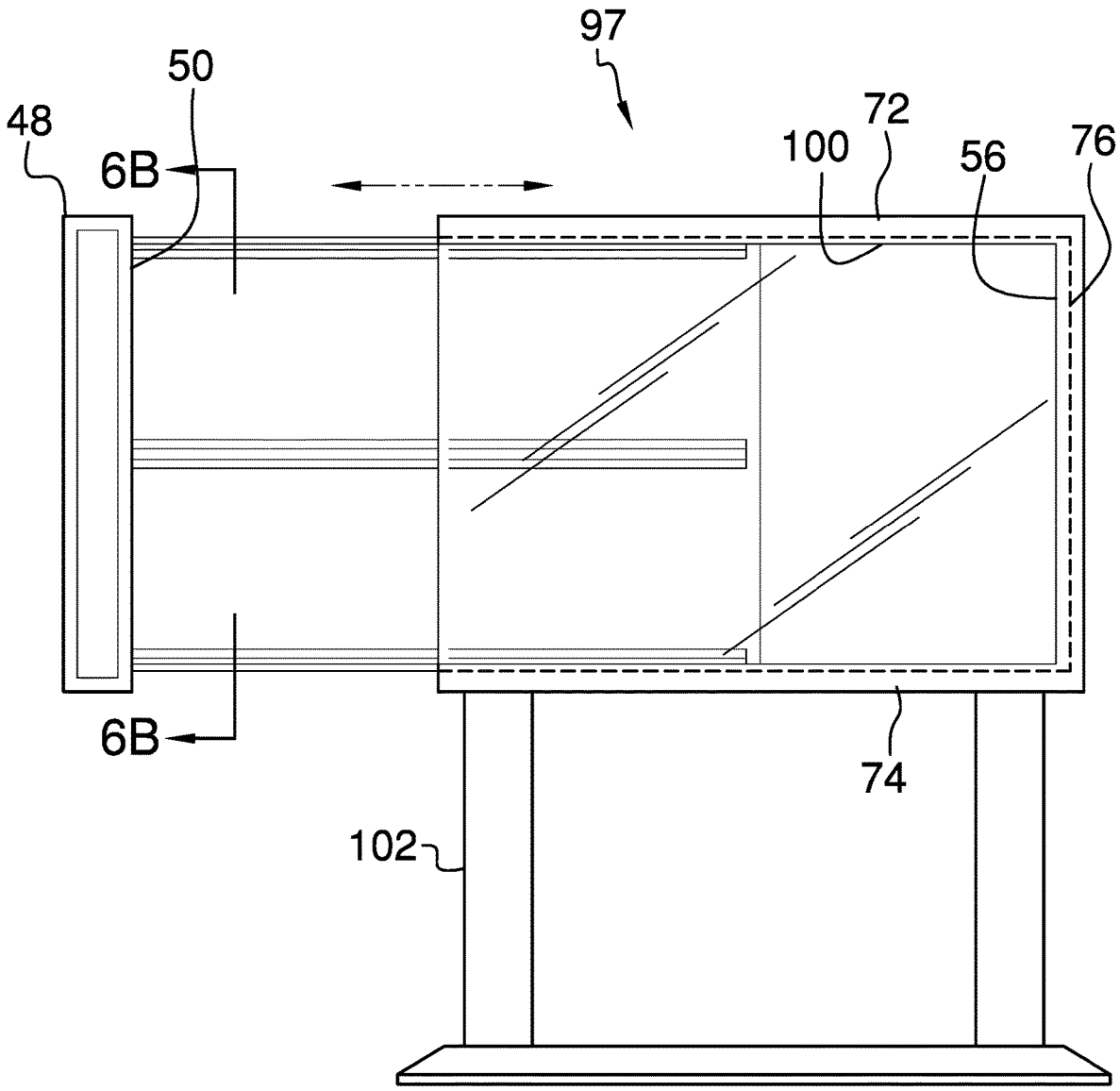
FIG. 5 is a perspective view of an alternative embodiment of the disclosure being positioned on a stand.
Figure 6A:
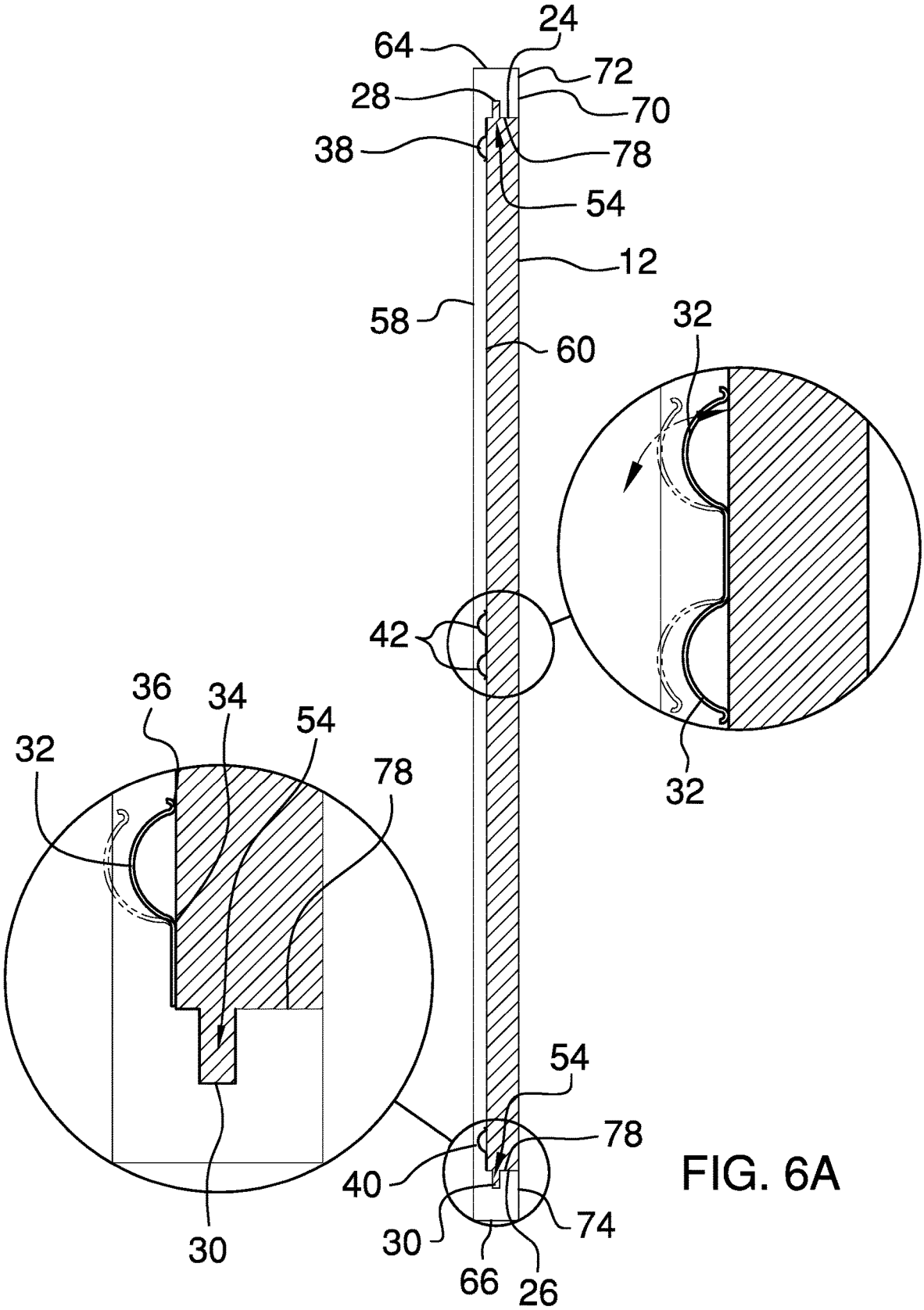
FIG. 6A is a cross sectional view taken along line 6A-6A of FIG. 2 of an embodiment of the disclosure.
Figure 6B:
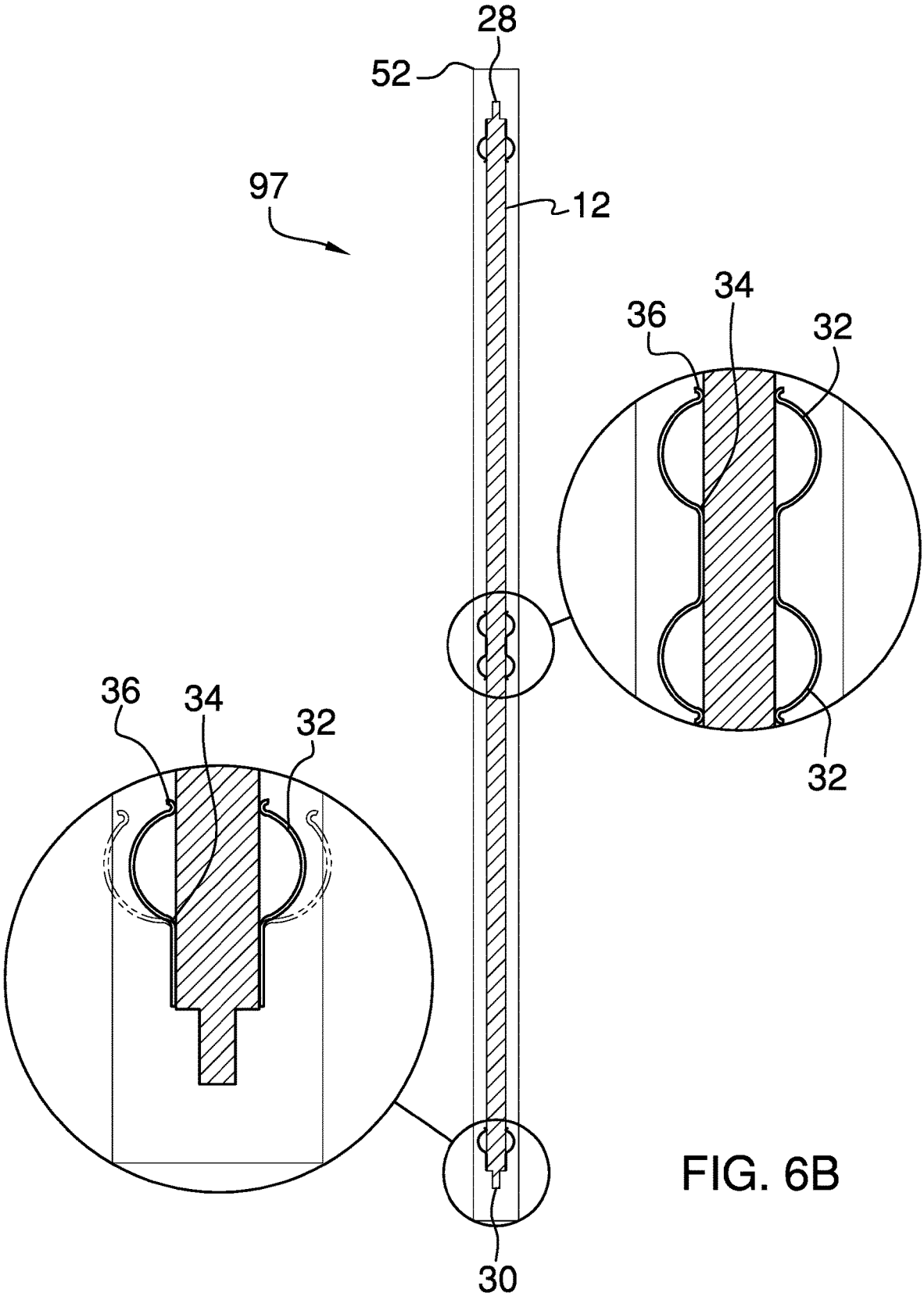
FIG. 6B is a cross sectional view taken along line 6B-6B of FIG. 5 of an embodiment of the disclosure.
Figure 7:
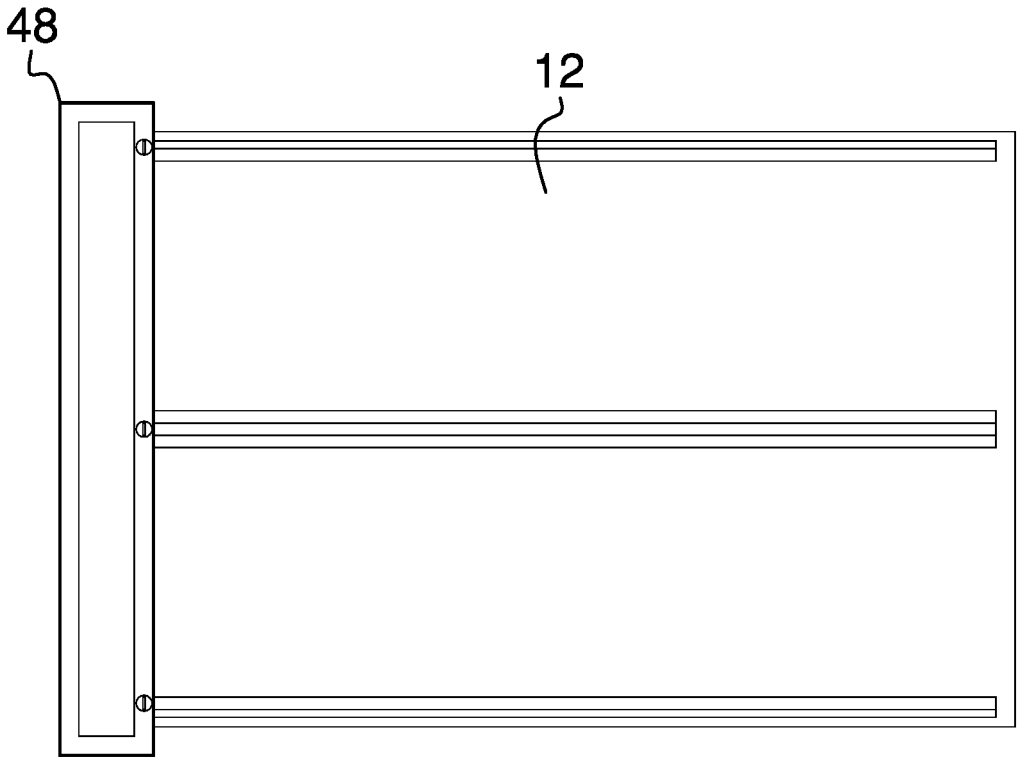
FIG. 7 is a back view of a panel of an embodiment of the disclosure.

In an alternative embodiment 97 as is most clearly shown in FIGS. 5 and 6B, a plurality of the clips 32 may each be coupled to a back surface 98 of the panel 12 for displaying the planar card 14 on the back surface 68 of the panel 12 as well as the front surface 16 of the panel 12. Additionally, the back wall 58 of the frame 52 may have a viewing opening 100 extending therethrough for displaying the planar card 14 on the back surface 98 of the panel 12. As is most clearly shown in FIG. 5, a stand 102 may be provided that engages the frame 52 for spacing the frame 52 upwardly from a support surface 104. In this way the planar card 14 on the front surface 16 of the panel and the planar card 14 on the back surface 68 of the panel 12 are viewable through the frame 52.

In use, the panel 12 is removed from the frame 52 and each of the planar cards 14 is positioned on a respective one of the first portion 44 or the second portion 46 of the panel 12. Additionally, the clips 32 are urged away from the panel 12 to facilitate the planar card 14 to be positioned between the clips 32 and the panel 12. The clips 32 are released to compress the planar card 14 between the panel 12 and the clips 32 for retaining the planar card 14 on the panel 12. The panel 12 is slid into the frame 52 until the member 48 abuts the frame 52. In this way the planar card 14 are displayed and protected in the frame 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A display device for storing and displaying planar card or other planar objects, said assembly comprising:

a panel having a plurality of planar card being positionable thereon;

a plurality of clips, each of said clips being coupled to said panel, each of said clips being biased to abut said panel wherein each of said clips is configured to grip a respective one of the planar card, each of said clips being urgeable away from said panel wherein each of said clips is configured to facilitate the planar card to be put into or taken out of said clips;

a frame having a pair of grooves therein for slidably engaging said panel, said frame having a viewing opening and a back wall, said viewing opening being open into an interior of said frame such that said panel is visible through said viewing opening wherein said frame is configured to display the planar card on said panel; and said panel having a front surface and a perimeter edge, said perimeter edge having a first lateral side, a second lateral side, a top side and a bottom side, said top side having a top rail extending upwardly therefrom, said top rail extending between said first lateral side and said second lateral side, said bottom side having a bottom rail, said bottom rail extending between said first lateral side and said second lateral side.

2. The assembly according to claim 1, wherein each of said clips has a first edge and a second edge, each of said clips being curved between said first edge and said second edge, said first edge of each of said clips being coupled to said front surface of said panel having each of said clips curving outwardly from said front surface, said second edge of each of said clips being biased to abut said front surface.

3. The assembly according to claim 2, wherein each of said clips is oriented to extend between said first lateral side and said second lateral side of said perimeter edge of said panel, said clips being spaced apart from each other and being distributed between said top side and said bottom side of said perimeter edge of said panel.

4. The assembly according to claim 3, wherein said plurality of clips includes a top clip, a bottom clip and a pair of middle clips, said top clip being aligned with said top side, said bottom clip being aligned with said bottom side, each of said middle clips each being centrally positioned between said top side and said bottom side, said top clips and said middle clips defining a first portion of said panel extending between middle clips and said top clip, said bottom clip and said middle clips defining a second portion of said panel extending between said middle clips and said bottom clip.

5. The assembly according to claim 1, further comprising a member having a sidelong edge, said sidelong edge being coupled to said first lateral side of said perimeter edge of said panel wherein said member is configured to be gripped by a user.

6. The assembly according to claim 1, wherein said back wall of said frame has a front surface and a peripheral edge, said peripheral edge having an upper side, a lower side and a first lateral side, said frame having a prominence extending forwardly from said front surface of said back wall, said prominence including an upper portion extending along said upper side of said peripheral edge, said prominence including a lower portion extending along said lower side of said peripheral edge, said prominence having a first lateral portion extending along said first lateral side of said peripheral edge.

7. A display device for storing and displaying planar card or other planar objects, said assembly comprising:

a panel having a plurality of planar card being positionable thereon;

a plurality of clips, each of said clips being coupled to said panel, each of said clips being biased to abut said panel wherein each of said clips is configured to grip a respective one of the planar card, each of said clips being urgeable away from said panel wherein each of said clips is configured to facilitate the planar card to be put into or taken out of said clips;

a frame having a pair of grooves therein for slidably engaging said panel, said frame having a viewing opening and a back wall, said viewing opening being open into an interior of said frame such that said panel is visible through said viewing opening wherein said frame is configured to display the planar card on said panel;

said back wall of said frame having a front surface and a peripheral edge, said peripheral edge having an upper side, a lower side and a first lateral side, said frame having a prominence extending forwardly from said front surface of said back wall, said prominence including an upper portion extending along said upper side of said peripheral edge, said prominence including a lower portion extending along said lower side of said peripheral edge, said prominence having a first lateral portion extending along said first lateral side of said peripheral edge; and each of said upper portion and said lower portion of said prominence having a first surface being directed toward a center of said front surface of said back wall, each of said grooves extending into said first surface of a respective one of said upper portion and said lower portion, each of said grooves extending along a full length of said respective upper portion and lower portion, each of said grooves slidably receiving a respective one of a top rail and a bottom rail on said panel.

8. The assembly according to claim 7, wherein:

said assembly includes a member being coupled to said panel; and each of a first slot and a second slot slidably receiving a respective one of said top rail and said bottom rail on said panel, said member on said panel abutting said frame when said panel is fully inserted into said frame, said first surface of said upper portion and said first surface of said lower portion defining said viewing opening.

9. The assembly according to claim 8, further comprising a window being coupled to said frame, said window covering said viewing opening wherein said window is configured to protect the planar card displayed in a case, said window being comprised of a translucent material wherein said window is configured to facilitate the planar card to be visible through said window.

10. A display device for storing and displaying planar card or other planar objects, said assembly comprising:

a panel having a plurality of planar card being positionable thereon, said panel having a front surface and a perimeter edge, said perimeter edge having a first lateral side, a second lateral side, a top side and a bottom side, said top side having a top rail extending upwardly therefrom, said top rail extending between said first lateral side and said second lateral side, said bottom side having a bottom rail, said bottom rail extending between said first lateral side and said second lateral side;

a plurality of clips, each of said clips being coupled to said panel, each of said clips being biased to abut said panel wherein each of said clips is configured to grip a respective one of the planar card, each of said clips being urgeable away from said panel wherein each of said clips is configured to facilitate the planar card to be put into or taken out of said clips, each of said clips having a first edge and a second edge, each of said clips being curved between said first edge and said second edge, said first edge of each of said clips being coupled to said front surface of said panel having each of said clips curving outwardly from said front surface, said second edge of each of said clips being biased to abut said front surface, each of said clips being oriented to extend between said first lateral side and said second lateral side of said perimeter edge of said panel, said clips being spaced apart from each other and being distributed between said top side and said bottom side of said perimeter edge of said panel, said plurality of clips including a top clip, a bottom clip and a pair of middle clips, said top clip being aligned with said top side, said bottom clip being aligned with said bottom side, each of said middle clips each being centrally positioned between said top side and said bottom side, said top clips and said middle clips defining a first portion of said panel extending between middle clips and said top clip, said bottom clip and said middle clips defining a second portion of said panel extending between said middle clips and said bottom clip;

a member having a sidelong edge, said sidelong edge being coupled to said first lateral side of said perimeter edge of said panel wherein said member is configured to be gripped by a user;

a frame having a pair of grooves therein for slidably engaging said panel, said frame having a viewing opening and a back wall, said viewing opening being open into an interior of said frame such that said panel is visible through said front side wherein said frame is configured to display the planar card on said panel, said back wall having a front surface and a peripheral edge, said peripheral edge having an upper side, a lower side and a first lateral side, said frame having a prominence extending forwardly from said front surface of said back wall, said prominence including an upper portion extending along said upper side of said peripheral edge, said prominence including a lower portion extending along said lower side of said peripheral edge, said prominence having a first lateral portion extending along said first lateral side of said peripheral edge, each of said upper portion and said lower portion said prominence having a first surface being directed toward a center of said front surface of said back wall, each of said grooves extending into said first surface of a respective one of said upper portion and said lower portion, each of said grooves extending along a full length of said respective upper portion and lower portion, each of said grooves slidably receiving a respective one of said top rail and said bottom rail on said panel, said member on said panel abutting said frame when said panel is fully inserted into said frame, said first surface of said upper portion and said first surface of said lower portion defining said viewing opening in said frame; and a window being coupled to said frame, said window covering said viewing opening wherein said window is configured to protect the planar card displayed in a case, said window being comprised of a translucent material wherein said window is configured to facilitate the planar card to be visible through said window.

* * * * *